United States Patent [19]

Sakuma

[11] Patent Number: 4,692,665

[45] Date of Patent: Sep. 8, 1987

[54] DRIVING METHOD FOR DRIVING PLASMA DISPLAY WITH IMPROVED POWER CONSUMPTION AND DRIVING DEVICE FOR PERFORMING THE SAME METHOD

[75] Inventor: Hiraku Sakuma, Tokyo, Japan

[73] Assignee: NEC Corporation, Japan

[21] Appl. No.: 882,174

[22] Filed: Jul. 7, 1986

[30] Foreign Application Priority Data

Jul. 5, 1985 [JP] Japan ..... 60-148615
May 15, 1986 [JP] Japan ..... 61-112173

[51] Int. Cl.[4] ..... G09G 3/10

[52] U.S. Cl. ..... 315/169.4; 340/771; 340/776

[58] Field of Search ..... 315/169.4; 340/771, 340/776

[56] References Cited

U.S. PATENT DOCUMENTS 3,551,721 12/1970 Holz ..... 315/169.4
3,614,509 10/1971 Wilson ..... 315/169.4
4,384,287 5/1983 Sakuma ..... 315/169.4

OTHER PUBLICATIONS

An ac-Refresh Panel with High-Voltage CMOS Drivers and Unbalanced Power Supplies, by: H. Sakuma et al., ISSN0097 . . . , pp. 99-102.

*Primary Examiner*—Harold Dixon
*Attorney, Agent, or Firm*—Laff, Whitesel, Conte & Saret

[57] ABSTRACT

A power consumption of a plasma discharge cells arranged in columns and lines is reduced by, while applying a scan pulse to the cell lines sequentially, applying a high voltage pulse and a low voltage pulse to those of cell columns, which are connected to plasma display cells to be illuminated, prior to and after an initiation of gas discharge in those cells, respectively. Display signal including the high voltage pulse and the low voltage pulse is derived from a circuit comprising a first transistor, a second and third transistors having sources connected directly or through a diode to a drain of the first transistor, means for applying the high voltage to a drain of the second transistor and means for applying the low voltage to a drain of the third transistor, the second and third transistors being operated alternatively to provide the display signal at the drain of the first transistor.

18 Claims, 7 Drawing Figures

DRIVING METHOD FOR DRIVING PLASMA DISPLAY WITH IMPROVED POWER CONSUMPTION AND DRIVING DEVICE FOR PERFORMING THE SAME METHOD

BACKGROUND OF THE INVENTION

1. Field of the Invention

The present invention relates to a method for driving a flat panel display and a driving circuit therefor, and, particularly, to a novel method for driving an X-Y dot matrix type AC-refresh plasma display panel which is effective to realize an increased display area with minimized power consumption, and a driving device for use in performing the same.

2. Description of the Related Art Including Information Disclosed Under Section 1.97 - 1.99

The plasma display device utilizes discharge phenomenon of rare gas and, in view of a recent strong demand of its application to a thin and lightweight displays for office and/or industrial automation, deligent efforts are being made to realize such devices as having a large display area and make them commercially available. The plasma display panel (PDP) can be classified generally into a d.c. type which utilizes d.c. discharge and an a.c. type which utilizes an a.c. discharge. Among the a.c. type panels, those in which display informations are stored as wall charge within the panel and then displayed are referred to as being of a memory type and those in which informations stored in an external memory are read out and displayed repeatedly are referred to as being of a refresh type, the both having respective features.

Among those plasma display panels, the a.c.-refresh type PDP is advantageous in that a structure thereof is simple and legibility, reliability and life-time are superior to the other. Luminance of the a.c.-refresh type PDP depends upon the number of light emissions of each discharge cell, i.e., the number of a.c. voltage pulses applied thereto. A conventional driving system for the refresh type X-Y dot matrix display panel is schematically shown in FIG. 1, in which line-at-a-time scanning system is employed. Scanning electrodes (line electrodes $Y_1 \ldots Y_n$) are sequentially selected by a scanning circuit 21 and a required series of high voltage pulses are applied thereto during each period of selection. At the same time, a series of high voltage pulses opposite in phase to the voltage pulses applied to the scanning electrodes are supplied from column electrodes ($X_1 \ldots X_m$) according to a data signal from an image data signal input circuit 22 and cells each located at a cross point of the both electrodes illuminate proportionally to the number of the applied pulses. Incidentally, $V_{SC}$ and $V_{DA}$ in the same figure depict power sources for the scanning circuit 21 and the image data signal input circuit 22, respectively. For a PDP having a large display area, however, the number of scanning electrodes required is at least 400. In order to obtain a satisfactory display luminance of such large PDP, it is necessary to increase a panel drive frequency correspondingly to the number of scanning electrodes. In fact, assuming that, in order to obtain such satisfactory display luminance, it is necessary to apply a.c. pulses at a rate of 2000 pulses/second to each display cell, a drive frequency required for such panel having 400 scanning electrodes becomes $2000 \times 400 = 800$ (KHz). Since a voltage necessary for gas discharge is usually 120–150 V (in either side), a high frequency and high voltage are required to drive such large a.c.-PDP, resulting in problems of making the conventional driving circuit possible to use higher frequency with reduced power consumption.

In view of such problems, uses of a high speed, high voltage CMOS driver which may be usable instead of the conventional high voltage bipolar driver and an unbalanced drive system in which a drive voltage on a scanning side is made as high as possible and a driving voltage on a data side is made as low as possible have been proposed by Sakuma et al. in "An AC Refresh PDP with High Voltage CMOS Drivers and Unbalanced Power Supplies", No. 7.5, page 99, Society for Information Display (SID)84 DIGEST, 1984. According to the proposition, a large area PDP with 400 scanning electrodes $\times$ 640 data electrodes, for instance, has been realized with a less power consumption of about one tenth that of the conventional method.

Also, in the recent information-oriented society, there is an increased demand of a display device whose power consumption is low enough to make it usable with a battery and whose display capability is much more improved. In order to drive such PDP with a battery, it has to operate with a power of several Watts at most. On the other hand, as to the display area, a realization of display panel containing a large number, say, 1000 to 2000, of scanning electrodes, is being required. When, for instance, the number of electrodes of a $400 \times 640$ dot display panel is doubled to realize a $800 \times 1280$ dot panel, the number of display dots becomes four times that of the $400 \times 640$ dot panel. Even if a scanning is possible by using a high speed CMOS driver, the power consumption of the panel may be increased at least four times due to increased driving frequency and increased load capacitance. Since, on the side of scanning electrodes which are driven line by line, the number of electrodes becomes twice and the load capacitance for each electrode becomes twice, the power to be consumed in the drive circuit becomes four times. On the other hand, on the data electrode side, frequency, the number of electrodes and load capacitance for each electrode are twice, respectively. Therefore, the power to the drive circuit becomes 8 times. Since the driving power on the data side of the a.c.-refresh PDP in which all electrodes are driven simultaneously is larger than that on the scanning side, the power consumption of the whole PDP when the display area is doubled is not 4 times but substantially 8 times.

SUMMARY OF THE INVENTION

An object of the present invention is to realize driving of a plasma display panel having large area with a reduced power consumption by substantially reducing a driving power on the side of data electrode by means of a novel data electrode driving system using a driver constructed according to a principle of plasma gas discharge.

According to one of features of the present invention, a method of driving a plasma display, in which an information is displayed by selectively illuminating plasma display cells in a matrix in line-sequence, comprises the steps of applying a series of scan pulses through the scanning electrodes, applying display signals of a first voltage through data electrodes to selected cells for an initiation of gas discharge together with scan pulse with a sum of the first voltage and the scan pulse voltage being substantially higher than a gas discharge initiation voltage, and applying the display signal of a second voltage together with the scan voltage pulse to the selected cells after gas discharge establishes, the second voltage being lower than the first voltage and enough to sustain gas discharge. The first voltage is a voltage pulse having a high magnitude and the second voltage is a voltage pulse lower than the first voltage. It is preferable to make a repetition frequency of th scan pulses higher during the period when the display signal takes the second voltage.

According to another feature of the present invention, a plasma display device comprises a display cell matrix having plurality of plasma display cells arranged in lines and columns, a plurality of line electrodes each connected commonly to the plasma display cells arranged in a line, a plurality of column electrodes each connected commonly to the plasma display cells arranged in a column, a scanning circuit for applying a scan pulse to the line electrodes sequentially, and a display signal supply circuit for supplying, together with the scan pulse, the first voltage the value of which is enough to start gas discharge, to plasma display cells and supplying, together with the scan pulse, the second voltage whose value is lower than the first voltage and enough to sustain gas discharge to the plasma display cells after the initiation of gas discharge. The display signal supply circuit may include a display signal control circuit which in turn has a first transistor, a second and a third transistors having electrodes connected commonly to an output electrode of the first transistor and means for deriving the display signal from the output electrode of the first transistor, whereby, when the display signal is to be derived, the first transistor is turned off and the second transistor is turned on to supply the first voltage to the output electrode of the first transistor at an initiation of discharge and, after the initiation of discharge, the third transistor is turned on to supply the second voltage to the output electrode of the first transistor. It may be possible to provide a plurality of the display signal control circuits in the display signal supply circuit correspondingly, in number, to the column electrodes or to provide a single display signal control circuit in combination with a plurality of switches so that the required voltages are selectively supplied to column electrodes containing plasma display cells to be illuminated.

According to a inventor's study of the relation between the driving pulse voltage and discharge emission phenomenon in the a.c.-refresh PDP, the following facts have been clarified. That is, in the improved PDP driving method disclosed in the article mentioned previously, a high voltage pulse the magnitude of which is as large as an upper limit of an operating voltage range in which erroneous operation due to one side drive hardly occur is applied from the scan side and a voltage high enough to initiate discharge is applied from the data side. At the selected cells, these two voltages opposite in phase to each other are superposed and when a sum of them exceeds the discharge initiation voltage, discharge emission occurs. In an example of large area PDP used in experiments conducted by the inventor, scan side drive voltage was about 170 V, in which case data side voltage required to initiate discharge was in the order of 45 V including a margin. It was found that once discharge is initiated and a stationary display is provided, there is no termination of discharge emission even if the data voltage is gradually decreased even below 45 V. When the data side voltage was further reduced gradually to around 30 V, emission at every display cell still continued. Below 30 V, emission was partially terminated. This fact may be thought due to that, once discharge initiates, the so-called wall charge grows within the discharge cell, which is held up to a subsequent discharge initiation, resulting in a discharge initiation voltage lowered for the subsequent discharge. In the present invention, at a time when a drive voltage pulse train is applied to discharge cells for a selected time period, a data the magnitude of which is necessary and enough to initiate a new discharge is applied thereto in an initial portion of the period and then the magnitude reduced, so that any selected discharge cell initiates emission reliably. On the other hand, if the reduced magnitude data is applied for a period of 90% or more of the selected period, it is possible to data drive power in reverse proportion to about a square of the data signal magnitude. Since the data side drive power occupies a very large part of the power consumption, it is possible to substantially reduce the power consumption of the whole display device by employing the present drive method. A sum of the scan side drive voltage and the data side voltage is applied to display cells as mentioned. Although such voltage applied to display cells was 215 V at discharge initiation in the above mentioned experiment, it may be usually selected in a range from 190 V to 350 V and, although the voltage applied to the display cell for sustaining discharge was 200 V in the above experiment, it may be selected usually in a range from 170 V to 200 V. It may be possible to initiate discharge with a single pulse. However in order to initiate a stable discharge, the number of pulses to be applied should be 10 or less and, preferably, 2 to 4.

BRIEF DESCRIPTION OF THE DRAWING

The above and further objects, features and advantages of the present invention will become apparent from the following detailed description of preferred embodiments taken in conjunction with the accompanying drawings, wherein.

DESCRIPTION OF THE PREFERRED EMBODIMENTS

Preferred embodiments of the present invention will now be described in detail with reference to the accompanying drawings.

Figure 1:
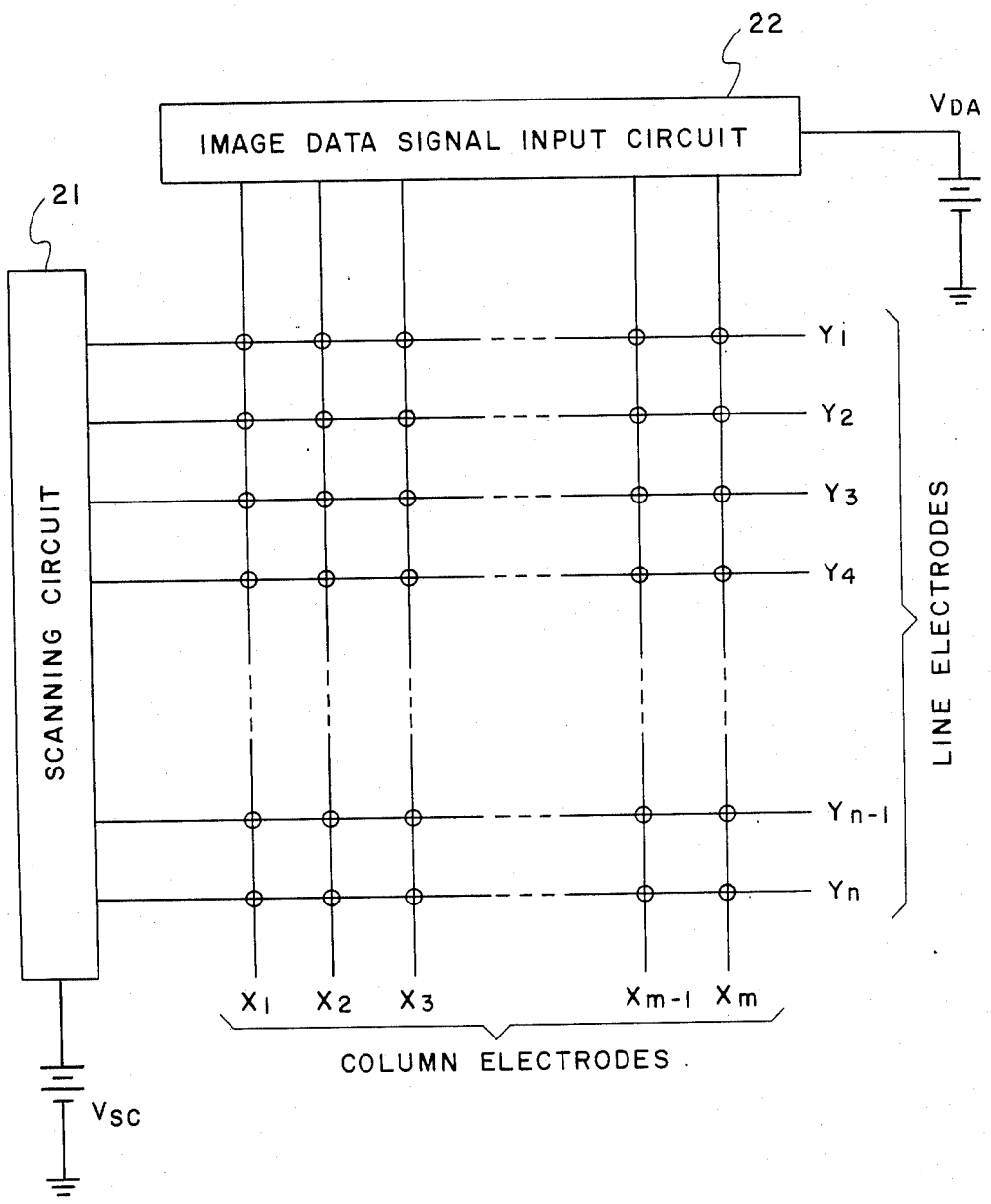
FIG. 1 is a circuit diagram for explaining a drive method of a conventional a.c.-refresh type plasma display.
Figure 2A:
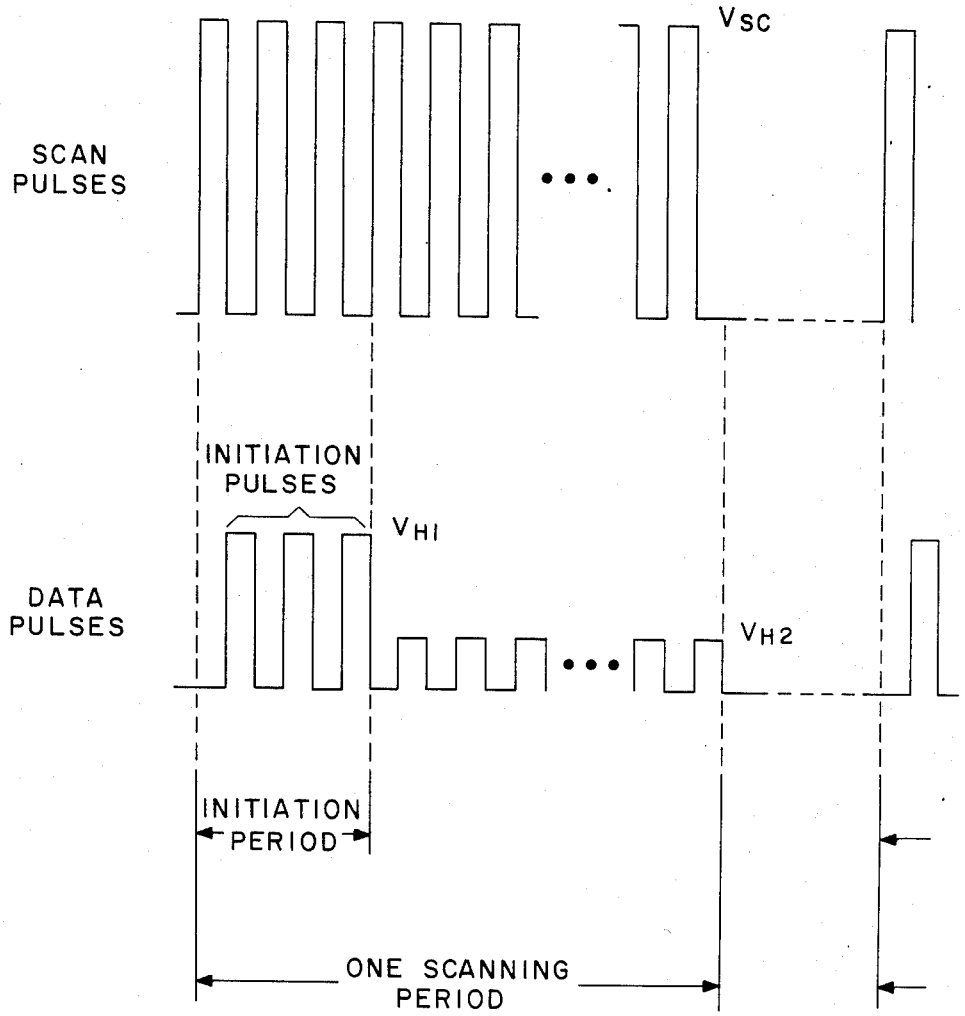
FIGS. 2A to 2C show waveforms of scan pulse and data pulse to be used in first to third embodiments of the present drive method of plasma display panels, respectively.

FIG. 2A shows high voltage pulse waveforms in scan and data sides of an embodiment for performing the present drive method. A PDP to which the present invention is applied is substantially the same as that shown and described in the article previously mentioned, basically, except a drive voltage pulse. In this embodiment, a scan pulse SP having a frequency of 1 MHz and a voltage $V_{SC}=170$ V is applied to selected scan electrode or electrodes and an initiation pulse voltage $V_{H1}$ (e.g. 60 V) which is relatively high to initiate gas discharge is applied as a data pulse DP to data electrodes. In FIG. 2A, three of such initiation pulses are shown. The number of initiation pulses depends upon characteristics of the display panel itself and voltage thereof. Therefore, a single such pulse may be used to initiate discharge if necessary. However, in order to obtain a stable discharge initiation characteristics, it is advisable to use ten of such pulses or less, preferably, 2 to 3 pulses. That is each initiation pulse should have a magnitude and width which are enough to initiate gas discharge and a repetitive rate enough to produce wall charge necessary to sustain initiated discharge constantly. Then, the data pulse voltage is reduced to $V_{H2}(=15$ V) which, together with scan pulse having voltage $V_{SC}=170$ V, is applied to the selected discharge cells for the remaining part of the scan period as a drive pulse signal having pulse repetitive frequency of 1 MHz, to thereby cause them to illuminate. When scanning of one frame is completed in this manner, the same selective scanning is repeated to display an information.

According to this embodiment, the data voltage for continuous discharge could be substantially reduced to a level of 15 V. This is because discharge is reliably initiated by such high pulse voltage at every scan initiation (60–70 times/sec) and wall charge which is enough to sustain discharge even with a lower voltage is produced every time. Although luminance may be lowered slightly when a sum ($V_{SC}+V_{H2}$) of a.c. drive pulse voltage is made small, it can be compensated for easily by increasing drive pulse frequency. In any way, since the data drive voltage can be reduced from conventional 45 V to 15 V in the present system, the power consumption during sustained discharge can be reduced to one-nineth ($=(15/45)^2$). It has been found that the data side power consumption of the present system is reduced to one fourth to one fifth that of the conventional system even if power of initiation pulse and high frequency power for maintaining luminance are taken into consideration. Therefore, according to the present invention, a total power consumption of a large area PDP having a doubled vertical length and a doubled horizontal length with respect to a conventional PDP, i.e., having display area which is four times that of the conventional PDP becomes only about twice that of the latter.

Figure 2B:
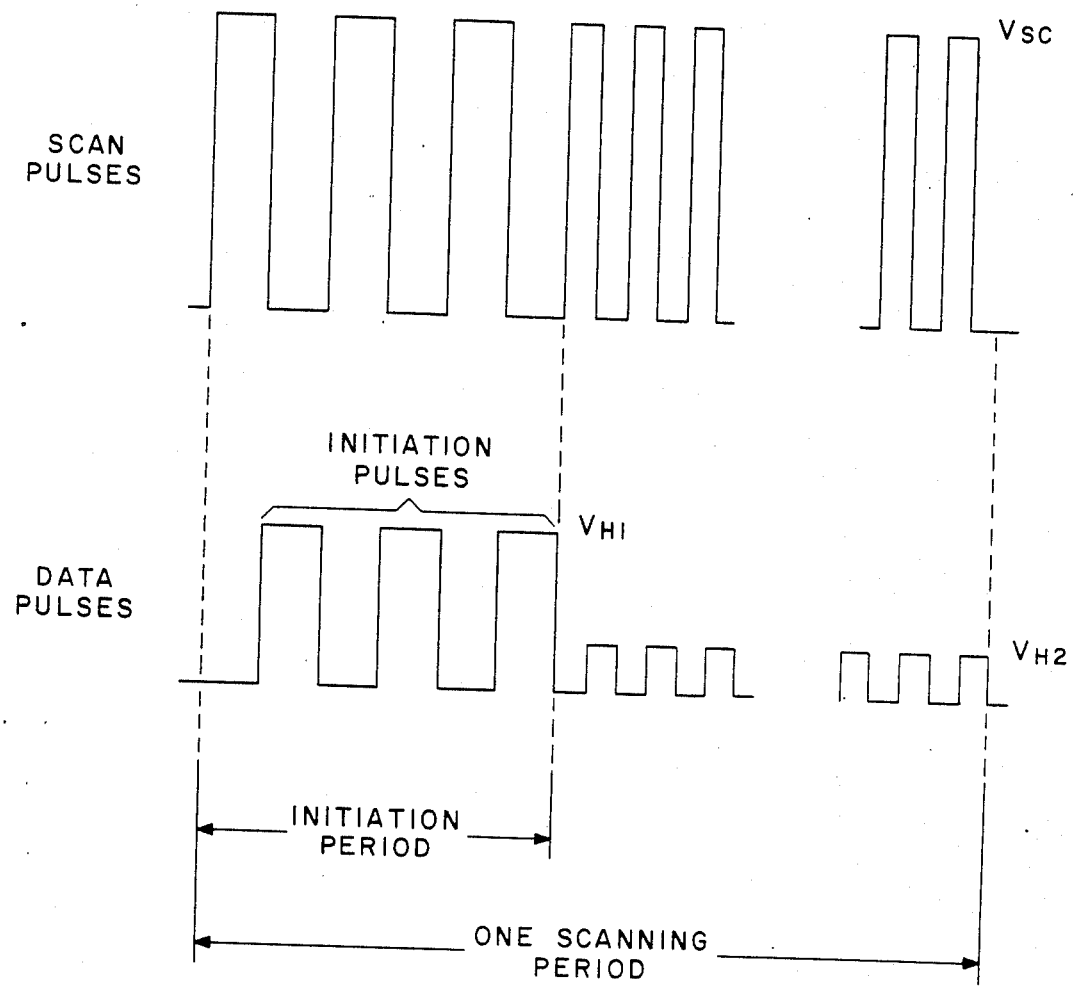

FIG. 2B is voltage pulse waveforms of a second embodiment of the present drive method. In this embodiment, the repetitive frequency of the initiation pulse is relatively low (e.g., 500 KHz) and drive frequency in a scan period for achieving a desired luminance is selected as being high (1 MHz or more). When the width of the initiation pulse is enough, a sufficient wall charge is produced in the width. Therefore, it is possible to further reduce the initiation voltage value. In this embodiment, it has been found that discharge is reliably initiated even if the ignition voltage $V_{H1}$ is as low as 35–40 V. According to the so-called frequency modulation driving of this type, it is advantageously possible to set a discharge initiation voltage which is uniform throughout a large area display panel with a reduced data side voltage.

Figure 2C:
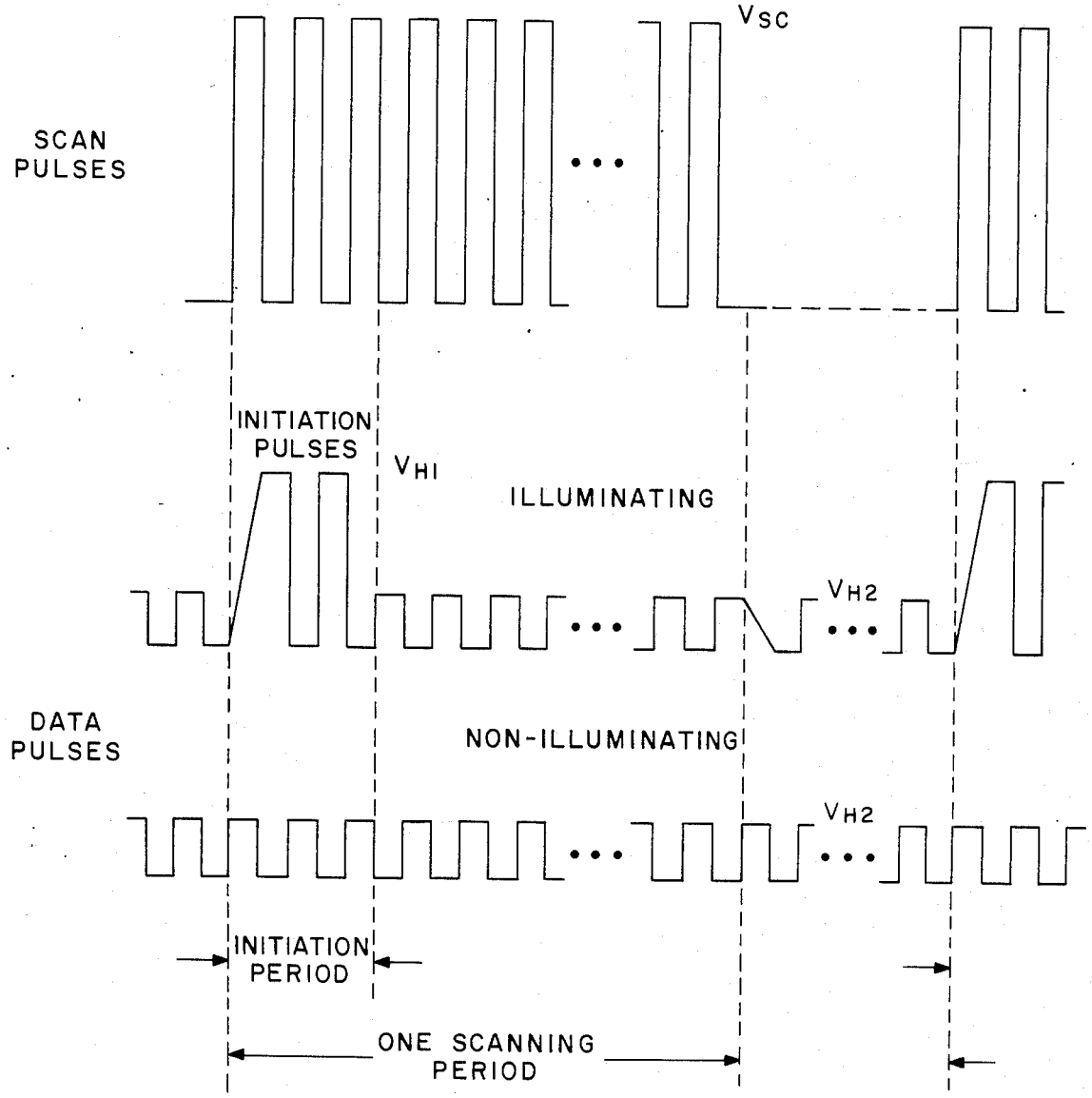

FIG. 2C shows waveforms of scan and data voltage pulses in a third embodiment of the present drive system. In this embodiment, scan pulse SP having a frequency of 1 MHz, and magnitude $V_{SC}=170$ V is applied to selected scan electrodes. On the other hand, data pulse DP is applied thereto, which is a low voltage pulse signal having magnitude $V_{H2}$ of 10 V and being in phase with the scan pulse SP when the selected cells are not illuminated. When the cells are to be illuminated a relatively high voltage initiation pulse $V_{H1}$ (e.g., 60 V), together with the scan pulse SP, is applied thereto for an initial part of illumination to initiate discharge, the pulse $V_{H1}$ being opposite in phase to the scan pulse SP. In this embodiment, a couple of initiation pulses are used for discharge initiation. After the initiation of discharge, the data pulse voltage is reduced to $V_{H2}$ (=10 V). Subsequently, in one scan period, a signal including scan pulse ($V_{SC}=170$ V) and a drive pulse ($V_{H2}=10$ V) and having repetition frequency of 1 MHz is applied to the scan and data electrodes of the selected discharge cells, respectively, to illuminate them. After such electrode scanning is completed for one frame in this manner, it is repeated sequentially to display an information.

To column electrodes connected to discharge cells to be not illuminated, a pulse which is in phase with the scan pulse and has a waveheight of 10 V is applied as mentioned above.

With this pulse application, voltage on the nonselected cells does not reach a threshold value for discharge initiation to thereby prevent erroneous illumination of them from occurring. This is because voltage applied to these cells is the scan pulse voltage reduced by data pulse. Therefore, even if the waveheight of the scan pulse is larger than those in the other embodiments, it is possible to completely suppress illumination of them. The higher the magnitude of scan pulse is the easier the discharge and the larger the wall charge injection. Therefore, the sustenance of discharge becomes easier.

Figure 3:
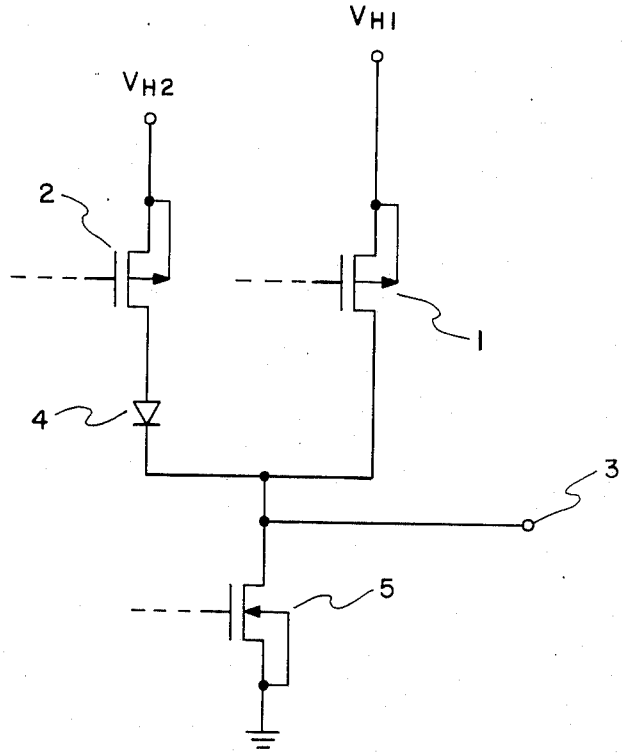
FIG. 3 is a circuit diagram showing an example of a circuit for producing data pulse.

FIG. 3 shows a circuit diagram for producing the data pulse which comprises a load transistor 1 connected to a high voltage power supply $V_{H1}$, a load transistor 2 connected to a low voltage power supply $V_{H2}$, a diode 4 connected between the load transistor 2 and an output terminal 3 of the circuit and a single drive transistor 5. These transistors can be on-off operated with independent timings from each other by respective gate input means (not shown). The initiation pulse $V_{H1}$ is produced by an inverter composed of the load transistor 1 and the drive transistor 5, which is separated from a circuit portion including the load transistor 2 by the diode 4. Then, the load transistor 1 is turned off and the pulse $V_{H2}$ is produced by a circuit portion including the load transistor 2 and the drive transistor 5. When the circuit has a CMOS construction with PMOS and NMOS transistors of high breakdown voltage as shown, the circuit can be operated at high speed with low power consumption.

With the circuit having such characteristics, it is easily possible to resolve a problem of producing both high voltage pulse and low voltage pulse by means of a compact circuit, which has been very difficult to realize. The output circuit may be composed of transistors of the same type or of bipolar elements, needless to say. When a multiple of load transistor stages each including a diode such as shown in FIG. 3 are used instead of each load transistor in FIG. 3, it is possible to produce a pulse output having two or more voltage levels with a single output circuit.

Figure 5:
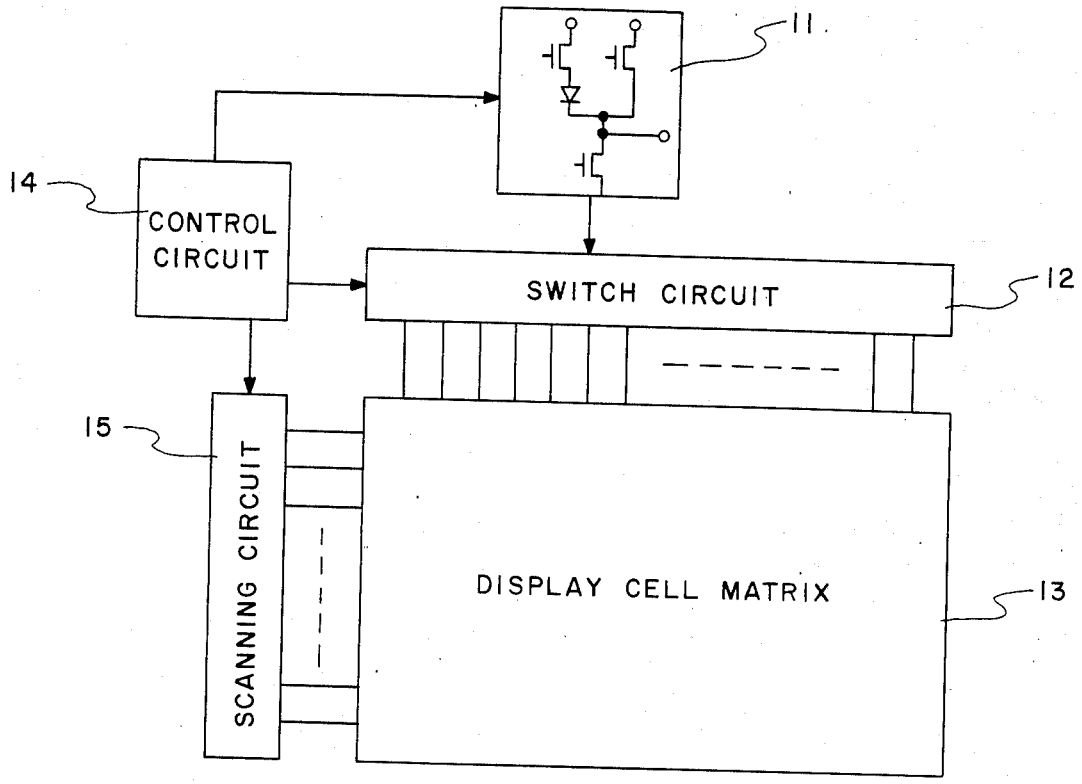
FIG. 5 is a block diagram showing another example of the plasma display panel in which the first and second embodiments of the present drive method are realized.
Figure 4:
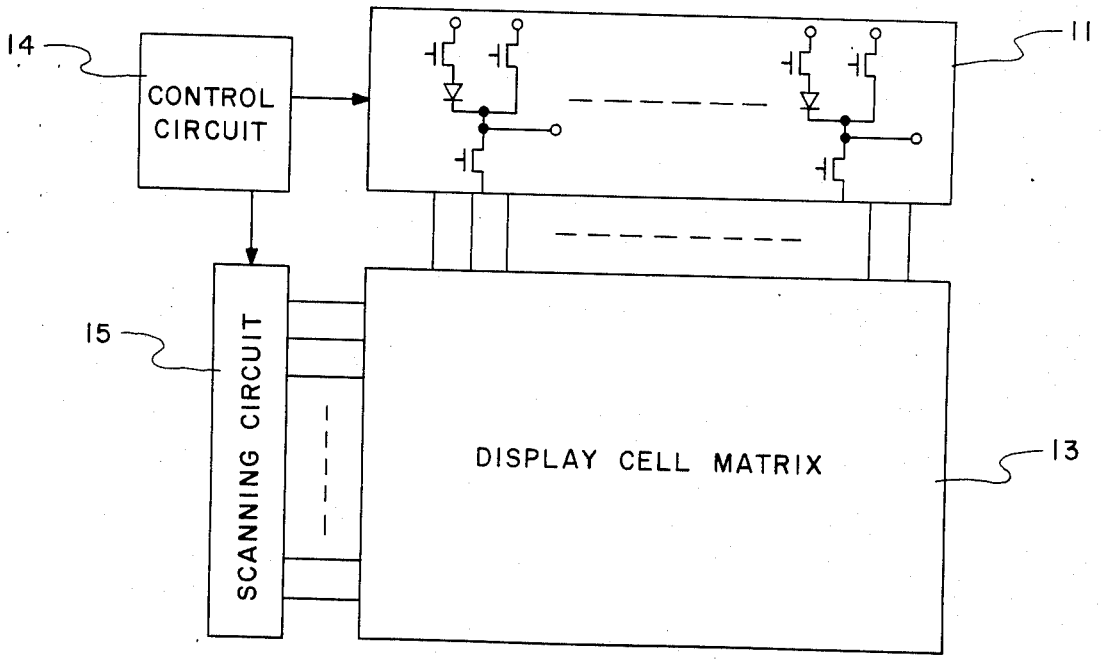
FIG. 4 is a block diagram showing an example of the plasma display panel, in which the respective embodiments of the present drive method are realized.

FIGS. 4 and 5 show display panel drive circuits each employing such output circuit as shown in FIG. 3, respectively. In FIG. 4, an output circuit 11 which is the circuit shown in FIG. 3 is provided for every column of a display cell matrix 13. A control circuit 14 controls the output circuits 11 connected to display cells to be illuminated to supply data pulses from the output circuits. A scanning circuit 15 which is also under a control of the control circuit supplies scan pulse to lines sequentially. This display panel drive circuit can realize any of the first to third embodiments.

In FIG. 5, a single output circuit 11 is used, and a switch circuit 12 is controlled by a control circuit 14 to supply data pulses to column connected to the display cells to be illuminated. This drive circuit can realize any of the first and second embodiments.

According to the driving system of the present invention, it is possible to uniformly initiate discharge and sustain initiated discharge of a dot matrix PDP with a low voltage and to substantially reduce the power consumption of the data side. Further, according to the circuit for producing the driving pulses of the present invention, it is possible to resolve the problem of providing a compact and inexpensive circuit capable of producing a plurality of high frequency, high voltage pulses different in frequency and magnitude from each other, which has been considered difficult to realize, and since such circuit can be easily formed in LSI, very large industrial merit is obtained.

Furthermore, according to the present invention, the total power consumption necessary for driving a PDP is reduced to several Watts which is about one third that of the conventional system. This means that the PDP can be used as a portable terminal display device to be powered by a battery and the utilization field of PDP is substantial enlarged. Further, according to the present driving system, a PDP having a large display area for times that of a conventional panel can be driven with power consumption which is only twice that of the conventional panel, at most. Therefore, the present invention largely attributes to a popularization and application of such large display area panel.

What is claimed is:

1. A method of driving a plasma display device including a plurality of plasma display cells arranged in a form of matrix, said plasma display cells arranged in each line being connected to a line electrode and said plasma display cells arranged in each column being connected to a column electrode, said method comprising the steps of:

applying a scan pulse to said line electrodes, sequentially;

applying a signal having a predetermined voltage to selected ones of said column electrodes connected to said plasma display cell or cells to be illuminated; and reducing said predetermined voltage of said signal to a value lower than said predetermined voltage after said cell or cells initiate illuminating.

2. The method claimed in claim 1, wherein said signal is composed of at least one voltage pulse.

3. The method claimed in claim 2, wherein the reduced voltage signal takes in the form of pulses.

4. The method claimed in claim 2, wherein said first high voltage signal is a pulse signal opposite in phase to said scan pulse.

5. The method claimed in claim 4, wherein a sum of voltage values of said signal and said scan pulse is larger than 190 to 300 volts.

6. The method claimed in claim 2, wherein a sum of voltage values of said signal and said scan pulse is larger than 170 to 200 volts.

7. The method claimed in claim 2, wherein said scan pulse has a low repetitive frequency when said predetermined voltage of said signal is applied and a high repetition frequency when said second low voltage signal is applied.

8. The method claimed in claim 1, wherein said signal is composed of a plurality of voltage pulses, the number of said voltage pulses being 10 or less.

9. The method claimed in claim 1, wherein a repetition frequency of said scan pulse is increased for a period when said predetermined voltage of said signal is reduced.

10. The method claimed in claim 1, wherein a pulse signal opposite in phase to said scan pulse is applied to said column electrode connected to other plasma display cells not to be illuminated.

11. In a method of driving a plasma display device having a plurality of plasma display cells each at one of cross points of a plurality of scan electrodes and a plurality of data electrodes to form a display cell matrix, in which a scan pulse is applied to said scan electrodes sequentially and a display signal is applied to said data electrodes to selectively illuminate said plasma display cells in a line sequence to thereby display an information, an improvement wherein said display signal includes a first voltage in a first period including a period of initiation of gas discharge, said first voltage being selected such that a sum of said scan pulse and said first voltage being substantially larger than a gas discharge initiation voltage and said display signal includes a second voltage in a second period after gas discharge initiates, said second voltage being smaller than said first voltage.

12. The method claimed in claim 11, wherein said first voltage is in the shape of pulse.

13. The method claimed in claim 12, wherein said second voltage is in the shape of pulse.

14. The method claimed in claim 11, wherein said scan pulse has first repetition frequency in said first period and a second repetition frequency higher than said first repetition frequency in said second period.

15. A plasma display device comprising a display cell matrix including a plurality of plasma display cells arranged in lines and columns, a plurality of line electrodes each commonly connected to said plasma display cells arranged in a column, a scanning circuit for applying a scan pulse to said line electrodes sequentially and a display signal supply circuit for applying together with said scan pulse, a first voltage, to said column electrodes connected to said plasma display cells to be illuminated, at an initiation of gas discharge, a sum of said scan pulse and said first voltage being enough to initiate gas discharge, and a second voltage, smaller than said first voltage and enough to sustain gas discharge after gas discharge, said display signal supply circuit being provided with a display signal control circuit including a first transistor, a second and third transistors having a common electrode connected to an output electrode of said first transistor and means for deriving a display signal from said output electrode of said first transistor, said display signal control circuit by operation to turn off said first transistor, when said display signal is to be derived, and at a gas discharge initiation, to turn on said second transistor to thereby apply said first voltage to said output electrode of said first transistor and, after gas discharge starts, to turn on said third transistor to thereby apply said second voltage to said output electrode of said first transistor.

16. The method claimed in claim 15, wherein said common electrode of said third transistor is connected through a diode to said output electrode of said first transistor, said diode being forward-biased.

17. The method claimed in claim 15, wherein said display signal control circuit is provided for every column.

18. The method claimed in claim 15, wherein an output of said display signal output circuit is connected with switches to respective column lines.

* * * * *